US010435914B2

(12) United States Patent
Ma

(10) Patent No.: US 10,435,914 B2
(45) Date of Patent: Oct. 8, 2019

(54) INTERCHANGEABLE CORE LOCK ASSEMBLIES

(71) Applicant: Delta Lock Company, LLC, Bohemia, NY (US)

(72) Inventor: Alvin Ma, Selden, NY (US)

(73) Assignee: Delta Lock Company, LLC, Bohemia, NY (US)

( * ) Notice: Subject to any disclaimer, the term of this patent is extended or adjusted under 35 U.S.C. 154(b) by 15 days.

(21) Appl. No.: 15/482,881

(22) Filed: Apr. 10, 2017

(65) Prior Publication Data

US 2017/0298651 A1 Oct. 19, 2017

Related U.S. Application Data

(60) Provisional application No. 62/322,493, filed on Apr. 14, 2016.

(51) Int. Cl.

| | |
|---|---|
| ***E05B 27/00*** | (2006.01) |
| ***E05B 55/00*** | (2006.01) |
| ***E05B 9/08*** | (2006.01) |
| ***E05B 63/00*** | (2006.01) |
| ***E05B 9/04*** | (2006.01) |

(52) U.S. Cl.

CPC ..... *E05B 27/0046* (2013.01); *E05B 9/04* (2013.01); *E05B 9/086* (2013.01); *E05B 27/0007* (2013.01); *E05B 55/005* (2013.01); *E05B 63/0056* (2013.01)

(58) Field of Classification Search

CPC ... E05B 9/00; E05B 9/04; E05B 9/041; E05B 9/084; E05B 9/086; E05B 27/00; E05B 27/0003; E05B 27/0007; E05B 27/0014; E05B 27/0046; E05B 55/00; E05B 55/005; E05B 63/0056

See application file for complete search history.

(56) References Cited

U.S. PATENT DOCUMENTS

| | | | |
|---|---|---|---|
| 100,738 | A | 3/1870 | Dwight |
| 884,260 | A | 4/1908 | Boyd |
| 1,864,883 | A | 6/1932 | Edward |
| 1,938,112 | A | 12/1933 | Schlage |
| 2,140,066 | A | 12/1938 | White |
| 2,275,362 | A | 3/1942 | Golden et al. |

(Continued)

FOREIGN PATENT DOCUMENTS

| | | |
|---|---|---|
| DE | 3233976 | 8/1983 |

*Primary Examiner* — Christopher J Boswell

(74) *Attorney, Agent, or Firm* — Gerald Hespos; Michael J. Porco; Adam Hotzoglou

(57) ABSTRACT

A locking device is provided including a housing, a barrel, an interchangeable core (IC), and a prong driver. The housing extending along a longitudinal axis and including a first slot. The barrel slidably disposed in a hollow interior of the housing, where the barrel is slidable along the longitudinal axis. The barrel including a second slot and a hollow interior to retain the IC. The IC including a key hole and coupled to the prong driver. The prong driver including an engaging element extending from the prong driver perpendicularly to the longitudinal axis into the first slot and the second slot. When a proper key is inserted into the key hole and rotated, the engaging element is rotated within the first and second slots to allow the barrel to slide along the longitudinal axis to lock and unlock the locking device.

20 Claims, 21 Drawing Sheets

(56) References Cited

U.S. PATENT DOCUMENTS 2,720,102 A 10/1955 Spain
2,938,373 A 5/1960 Gray et al.
3,262,292 A 7/1966 Glass
3,345,838 A * 10/1967 Russell ..... E05B 65/0864 70/100
3,423,968 A 1/1969 Foote
3,503,233 A 3/1970 Russell et al.
3,563,593 A 2/1971 Leier
3,589,152 A 6/1971 Glass
4,009,599 A * 3/1977 Patriquin ..... E05B 65/0864 70/100
4,067,599 A 1/1978 Cohn
4,356,580 A 11/1982 Kurtz
4,617,810 A 10/1986 Fish
4,630,457 A 12/1986 Kincaid
4,672,827 A 6/1987 Craig
4,708,006 A 11/1987 Hodgson
4,756,638 A 7/1988 Neyret
4,768,360 A * 9/1988 Foshee ..... E05B 65/0864 70/100
4,809,525 A * 3/1989 Cox ..... E05B 9/086 70/100
4,899,563 A 2/1990 Martin
4,920,774 A 5/1990 Martin
5,010,753 A * 4/1991 Boris, Jr. ..... E05B 9/086 70/369
5,038,589 A 8/1991 Martin
5,101,649 A 4/1992 Duval
5,121,619 A 6/1992 Martin
5,251,467 A 10/1993 Anderson
5,315,850 A 5/1994 Edeus
5,548,981 A 8/1996 Kirk
5,590,555 A 1/1997 Kester et al.
5,615,566 A 4/1997 Brandt
5,657,652 A 8/1997 Martin
5,678,438 A * 10/1997 Kolkman ..... E05B 9/084 70/370
5,737,950 A 4/1998 Yun-Bin
5,813,260 A * 9/1998 Widen ..... E05B 9/086 70/369
5,873,272 A * 2/1999 Thompson ..... E05B 9/084 70/100
5,970,760 A * 10/1999 Shen ..... E05B 9/084 70/369
6,035,673 A 3/2000 Harrison
6,079,241 A 6/2000 Burleigh et al.
6,161,404 A 12/2000 Westwinkel
6,393,882 B1 5/2002 Higgins
6,523,379 B2 2/2003 Teskey
6,606,890 B1 * 8/2003 Widen ..... E05B 9/04 70/369
6,708,539 B1 * 3/2004 Widen ..... E05B 9/04 70/369
6,920,770 B2 7/2005 Lurie et al.
7,340,928 B2 3/2008 Hoffman
7,716,958 B2 5/2010 Martin
7,836,735 B2 11/2010 Liu
7,874,189 B2 1/2011 Martin
7,895,867 B2 3/2011 Hsieh
8,028,555 B2 10/2011 Lurie
8,444,100 B2 5/2013 Takahashi et al.
8,776,557 B2 7/2014 Wang
8,842,422 B2 9/2014 Hung et al.
8,905,693 B2 12/2014 Coffland
8,919,156 B1 12/2014 Liu
8,978,426 B2 3/2015 Wang
9,234,369 B2 1/2016 Gupta et al.
9,267,310 B2 2/2016 Linnasen et al.
10,184,270 B2 1/2019 Bullwinkel
2005/0011239 A1 1/2005 Lurie et al.
2005/0271494 A1 12/2005 Hidalgo
2006/0086162 A1 4/2006 Huang
2007/0227209 A1 10/2007 Massard
2009/0071209 A1 3/2009 Lurie
2010/0031717 A1 2/2010 Lurie et al.
2011/0127795 A1 6/2011 Still
2011/0132047 A1 6/2011 Terhaar et al.
2011/0316325 A1 12/2011 Martin
2014/0037399 A1 2/2014 Hyatt
2015/0176307 A1 6/2015 Bullwinkel
2016/0281393 A1 9/2016 Bullwinkel
2017/0298651 A1 10/2017 Ma

* cited by examiner

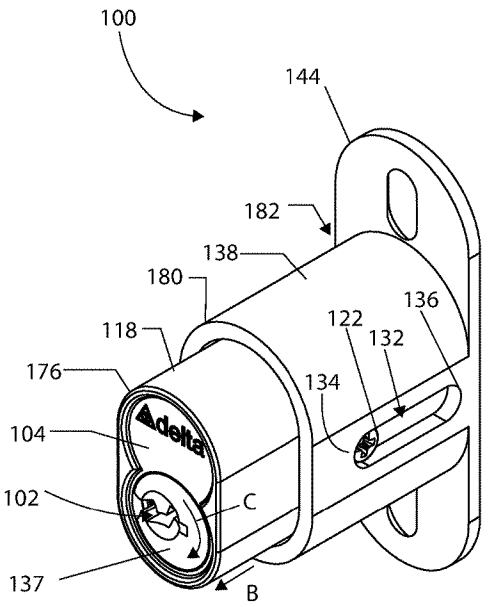
UNLOCKED FIG. 1B
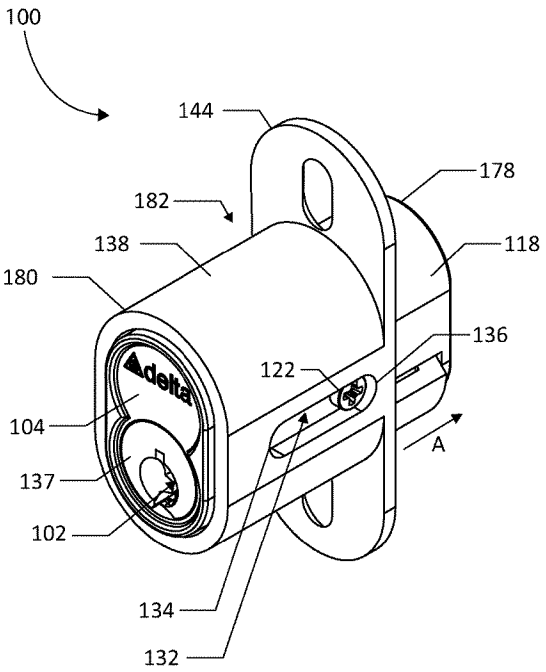
LOCKED FIG. 1A

Locked

Open

UNLOCKED

LOCKED

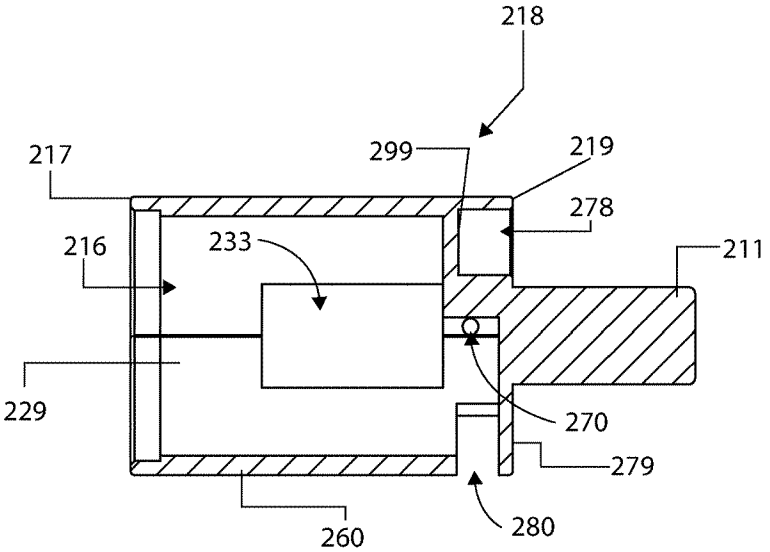
SECTION A-A
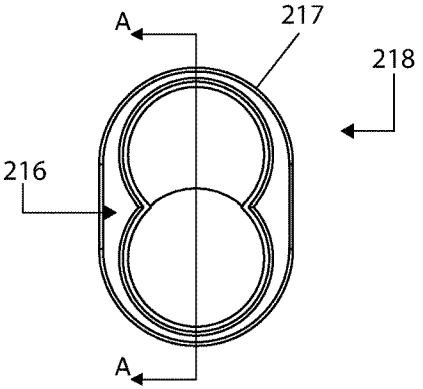
FIG. 13E

INTERCHANGEABLE CORE LOCK ASSEMBLIES

PRIORITY

The present application also claims priority to U.S. Provisional Patent Application Ser. No. 62/322,493 filed Apr. 14, 2016, entitled "INTERCHANGEABLE CORE LOCK ASSEMBLIES", the contents of which are hereby incorporated by reference in its entirety.

TECHNICAL FIELD

The present disclosure relates generally to lock mechanisms, and more particularly, to lock assemblies for use with lock cylinders of interchangeable core cylinder types.

BACKGROUND

Numerous types of cylinders for locks are known and popularly used for various applications. For example, locks known in the industry as "interchangeable core cylinder" locks are used to provide a lock wherein the core cylinder can be removed from the lock housing through the use of a control key. A different interchangeable core cylinder can then be inserted into the lock housing, whereby the user can quickly and easily change a lock or locks without calling a locksmith.

Currently, many of the designs of locks that accommodate interchangeable core cylinders provide inefficient and bulky locking mechanisms. Therefore, a need exists for locks that accommodate interchangeable core cylinders while providing more efficient, space saving locking mechanisms than currently available designs.

SUMMARY

Lock assemblies for use with lock cylinders of interchangeable core cylinder types are provided.

In one aspect of the present disclosure, a locking device is provided including: a housing including a first end and a second end, the housing extending from the first end to the second end along a longitudinal axis, the housing further including an outer wall defining a hollow interior of the housing and a first slot, the first slot disposed through the outer wall of the housing and including a first end, a second end, and a middle point, wherein a first portion of the first slot extends along the longitudinal axis from the first end to the middle point and a second portion of the slot extends perpendicularly to the longitudinal axis from the middle point to the second end; a barrel including a first end and a second end, the second end of the barrel disposed through the first end of the housing into the hollow interior of the housing such that the barrel is slidable along the longitudinal axis, the barrel further including an outer wall defining a hollow interior and a second slot disposed through the outer wall of the barrel, the second slot including a first end and a second end and extending perpendicularly to the longitudinal axis, the first end of the barrel configured to receive an interchangeable core such that the interchangeable core is retained in the hollow interior of the barrel; the interchangeable core including a first end and a second end, the first end including a key hole and the second end including a first channel and a second channel, the first channel and the second channel extending from the second end of the interchangeable core into the interior of the interchangeable core along the longitudinal axis; and a prong driver including an engaging element, a first prong, and a second prong, the engaging element extending from the prong driver into the first slot and the second slot in a direction perpendicular to the longitudinal axis, the first prong and second prong each extending from the prong driver along the longitudinal axis into the interior of the interchangeable core such that the first prong is disposed in the first channel and the second prong is disposed in the second channel, wherein when a proper key is inserted into the key hole of the interchangeable core and rotated in a first direction or a second direction opposite the first direction, the engaging element of the prong driver is rotated in the first direction or the second direction perpendicular to the longitudinal axis, wherein when the locking device is in a locked position, the engaging element is disposed through the second end of the first slot and the second end of the second slot such that the alignment of the second portion of the first slot perpendicular to the longitudinal axis prevents the barrel from sliding along the longitudinal axis, and wherein to unlock the locking device, the proper key is inserted into the key hole to rotate the engaging element such that the engaging element advances from the second end of the first slot to the middle point of the first slot and from the second end of the second slot to the first end of the second slot, thereby allowing the barrel to be advanced along the longitudinal axis in a direction away from the housing as the engaging element slides from the middle point of the first slot to the second end of the second slot along the longitudinal axis.

In another aspect of the present disclosure, a locking device is provided including: a housing including a first end and a second end, the housing extending from the first end to the second end along a longitudinal axis, the housing further including an outer wall defining a hollow interior of the housing and a first surface on the second end of the housing, the hollow interior including an inner wall, the inner wall including a first slot extending from the first surface toward the first end of the housing; a barrel including a first end and a second end, the second end of the barrel disposed through the first end of the housing into the hollow interior of the housing such that the barrel is slidable along the longitudinal axis, the barrel further including an outer wall defining a hollow interior and a second slot disposed in the outer wall of the barrel, the second slot including a first side and a second side, the second slot further including a second surface that is recessed from the outer wall of the barrel and a first aperture configured to provide access to the hollow interior of the barrel, the first end of the barrel configured to receive an interchangeable core such that the interchangeable core is retained in the hollow interior of the barrel; the interchangeable core including a first end and a second end, the first end including a key hole and the second end including a first channel and a second channel, the first channel and the second channel extending from the second end of the interchangeable core into the interior of the interchangeable core along the longitudinal axis; a retaining piece disposed in the second slot, the retaining piece including a first portion and a second portion, the first portion extending perpendicularly to the longitudinal axis through aperture of the second slot and into the hollow interior of the housing, the first portion including a non-circular aperture, the second portion extending from the first portion along the longitudinal axis and disposed adjacent to the second surface of the first slot such that at least part of the second portion of the retaining piece protrudes passed the outer wall of the barrel toward the exterior of the outer barrel; and a prong driver including a non-circular peg, a first prong, and a second prong, the non-circular peg extending into the non-circular aperture of the retaining piece, the non-circular peg and the non-circular aperture having the same shape, the first prong and second prong each extending from the prong driver along the longitudinal axis into the interior of the interchangeable core such that the first prong is disposed in the first channel and the second prong is disposed in the second channel, wherein when a proper key is inserted into the key hole of the interchangeable core and rotated, the prong driver is rotated, thereby rotating the second portion of the retaining piece perpendicularly to the longitudinal axis such that the second portion of the retaining piece is advanced toward the first side of the first slot or second side of the first slot by rotating the proper key within the key hole, wherein when the locking device is in a locked position, the retaining piece and the second end of the barrel are disposed passed the second end of the housing and the second portion of the retaining piece is disposed toward the first side of the second slot such that the second portion of the retaining piece adjacent to the first surface of the housing, thereby preventing the barrel from being slidably advanced toward the first end of the barrel along the longitudinal axis to an unlocked position, and wherein to unlock the locking device, the proper key is inserted into the key hole and rotated to rotate the second portion of the retaining piece from the first end of the second slot toward the second end of the second slot such that the second portion of the retaining piece is aligned with the first slot, thereby allowing the barrel to be advanced along the longitudinal axis in a direction toward the first end of the housing as the retaining piece slides along the longitudinal axis into the first slot.

BRIEF DESCRIPTION OF THE DRAWINGS

The above and other aspects, features, and advantages of the present disclosure will become more apparent in light of the following detailed description when taken in conjunction with the accompanying drawings in which:

FIG. 1A is a perspective view of a locking device in a locked position in accordance with an embodiment of the present disclosure;

FIG. 1B is a perspective view of the locking device of FIG. 1A in an unlocked position in accordance with an embodiment of the present disclosure;

FIG. 13E is a cross-sectional view of the barrel shown in FIG. 13A in accordance with an embodiment of the present disclosure;

It should be understood that the drawings are for purposes of illustrating the concepts of the disclosure and are not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Referring to FIGS. 1A and 1B a locking device 100 is shown in accordance with the present disclosure. FIG. 1A includes a perspective view of locking device 100 in a locked position and FIG. 1B includes a perspective view of locking device 100 in an unlocked position, as will be described in greater detail below.

Figure 2A:
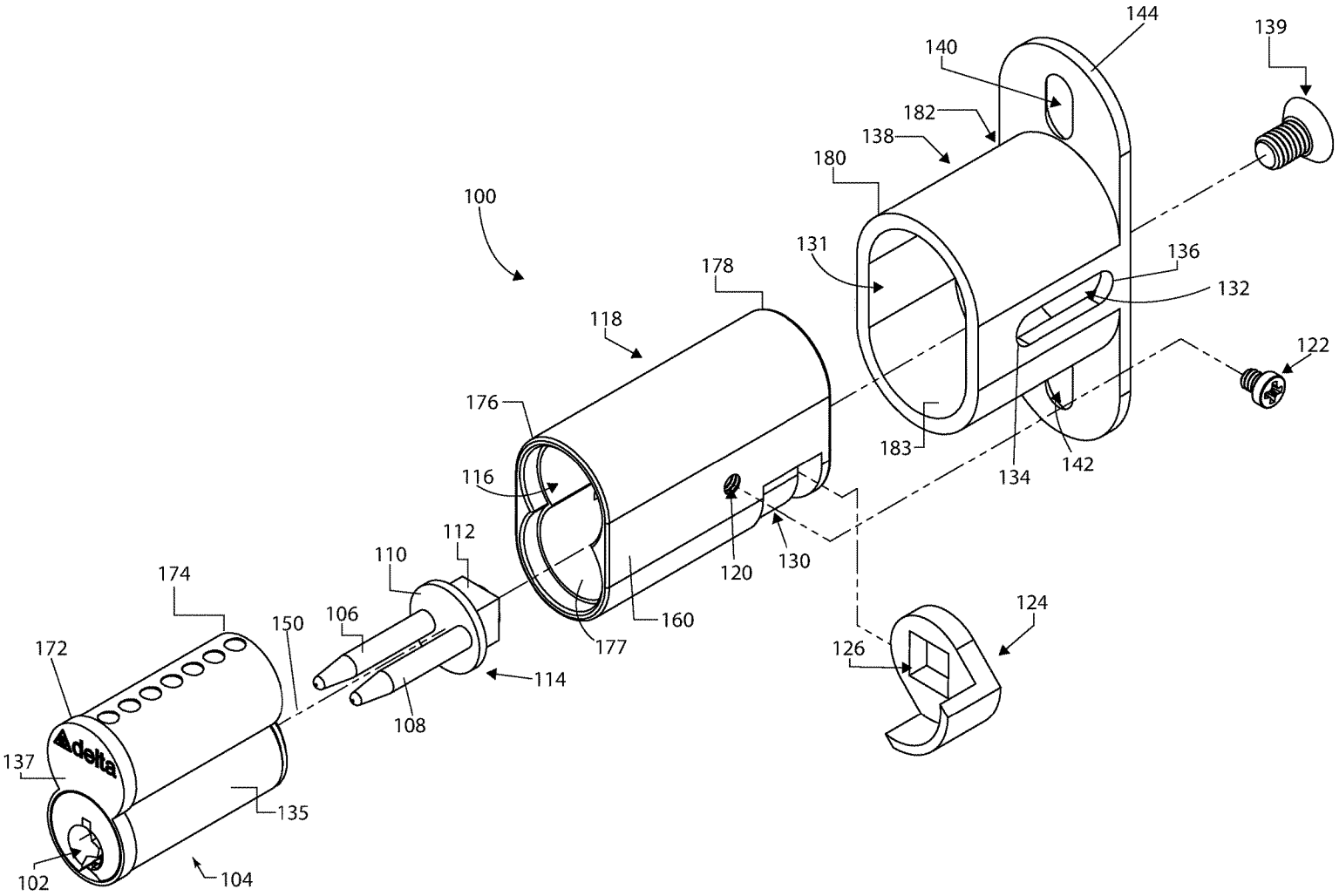
FIG. 2A is an exploded perspective view of the locking device of FIG. 1A in accordance with an embodiment of the present disclosure.

Referring to FIG. 2A, an exploded perspective view of locking device 100 is shown in accordance with the present disclosure. Locking device 100 includes an interchangeable core 104, which includes a key hole 102. In one embodiment, interchangeable core 104 is configured as a small format interchangeable core (SFIC), however, it is to be appreciated that in other embodiments interchangeable core 104 may be configured as a large format interchangeable core or other type of interchangeable core in accordance with the present disclosure.

Figure 2C:
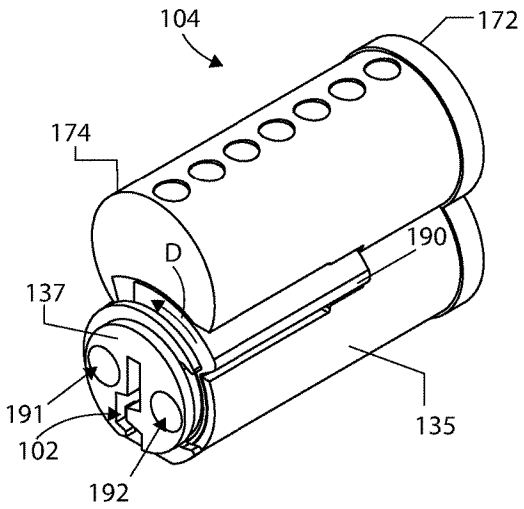
FIGS. 2B and 2C are perspective views of an interchangeable core of the locking device of FIG. 1A in accordance with an embodiment of the present disclosure.
Figure 2B:
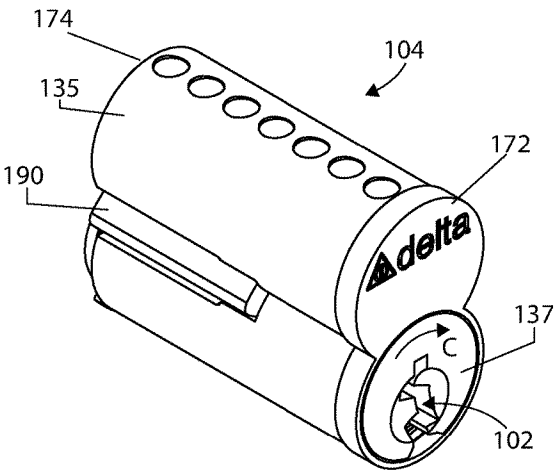

Referring to FIGS. 2B and 2C perspective views of SFIC 104 are shown in accordance with the present disclosure. As shown in FIGS. 2B and 2C, SFIC 104 includes an SFIC housing 135 having ends 172 and 174. A cylinder 137 extends along the longitudinal axis 150 from end 172 to end 174 of SFIC 104. Key hole or keyway 102 is disposed through cylinder 137 from ends 172, 174 along longitudinal axis 150. SFIC 104 also includes an engaging element 190 and channels 191, 192, where channels 192, 192 extend along longitudinal axis 150 into the interior of SFIC 104. When a proper or operating key is inserted into key hole 102 of SFIC 104, a plurality of tumblers within SFIC 104 align to allow cylinder 137 to be rotated, for example in a direction C shown in FIGS. 1B and 2B, to lock and unlock device 100, as will be described in greater detail below. In one embodiment, when a master or control key (different than the key used to lock and unlock locking device 100) is inserted into key hole 102 and rotated in a direction C, SFIC 104 is configured such that engaging element 190 may be drawn toward the interior of SFIC 104, as indicated by arrow D in FIG. 2C. It is to be appreciated that SFIC 104 includes a spring or coil within the interior of SFIC 104 that biases engaging element in a direction opposite to arrow D away from SFIC 104 (i.e., perpendicularly to the longitudinal axis 150).

Referring again to FIG. 2A, channels 191, 192 of SFIC 104 are configured to receive prongs 106 and 108, respectively, of a driver 114 to couple driver 114 to SFIC 104. Prongs 106 and 108 are coupled to a plate 110 of driver 114, where prongs 106 and 108 extend perpendicularly from a surface of plate 110 along longitudinal axis 150. Plate 110 is also coupled to a non-circular peg 112, where peg 112 extends perpendicularly from a surface of plate 110 along longitudinal axis 150 in a direction opposite to prongs 106 and 108. When a proper key is inserted into key hole 102 and rotated in a first direction (e.g., direction C), cylinder 137 is also rotated in the first direction, thereby rotating channels 191, 192 and driver 114 in the first direction. Peg 112 is configured to be received by a non-circular aperture or slot 126 of a housing retention piece 124, described in greater detail below. In one embodiment, the peg 112 and slot 126 are both configured to be shaped as squares, however, other non-circular shapes for peg 112 and slot 126 are contemplated to be within the scope of the present disclosure.

SFIC 104 is disposed through end 176 of hollow interior 116 of barrel 118, where barrel 118 includes ends 176 and 178. Barrel 118 further includes an outer wall 160, inner wall 177, aperture 120, and slot 130. Aperture 120 is disposed through outer wall 160 of barrel 118 and is configured to receive travel stop 122. Slot 130 is configured to receive housing retention piece 124, as will be described in greater detail below. Barrel 118 is disposed in the end 180 of hollow interior 131 of housing 138, where housing 138 includes ends 180 and 182. It is to be appreciated that SFIC 104, barrel 118 and housing 138 are each aligned along longitudinal axis 150.

Housing 138 includes a plate or mounting member 144 disposed at end 182, where plate 144 includes apertures 140 and 142 for mounting locking device 100 to a surface, such as the surface of a door. Housing 138 also includes a slot 132 aligned along longitudinal axis 150 and having an end 134 and an opposite end 136. When barrel 118 is disposed within interior 131 of housing 138, a portion of travel stop 122 is disposed through slot 132. It is to be appreciated that when a proper key (i.e., a key other than the master or control key) is inserted into key hole 102 and rotated (e.g., in a direction C shown in FIG. 1B or in a direction opposite to C), barrel 118 is movable along longitudinal axis 150 within housing 138. Slot 132 controls and limits the longitudinal front and back motion of barrel 118. When the locking device 100 is locked (as shown in FIG. 1A), travel stop 122 will be at end 136 of slot 132 and a portion of barrel 118 will extend past plate 144 of housing 138 in a direction A (as shown in FIG. 1A).

It is to be appreciated that in the locked position, end 178 of barrel 118 extends past plate 144 of housing 138 and is configured to interact with a receptacle, such as a door jam, to secure an object, such as a door, in a locked or closed position. When locking device 100 is unlocked (as shown in FIG. 1B), travel stop 122 will be at end 134 of slot 132 and end 176 of barrel 118 will extend past end 180 of housing 138 in a direction B (as shown in FIG. 1A). It is to be appreciate that a screw or other securing means 139 is used to couple driver 114 to barrel 118, as will be described in greater detail below.

Figure 3A:
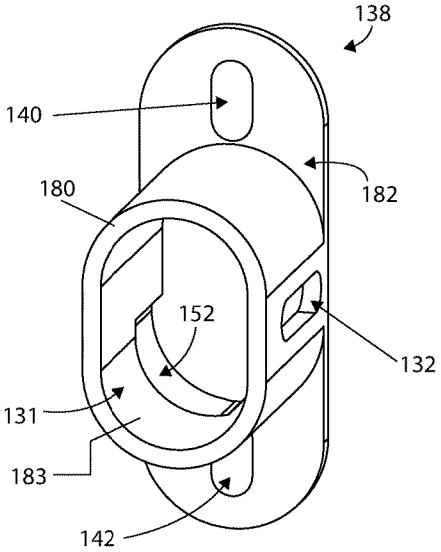
FIG. 3A is a perspective view of a housing of the locking device of FIG. 1A in accordance with an embodiment of the present disclosure.
Figure 3C:
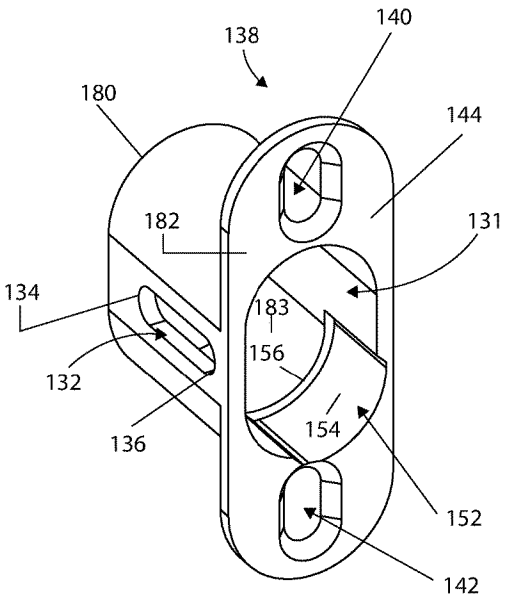
FIG. 3C is another perspective view of the housing shown in FIG. 3A in accordance with an embodiment of the present disclosure.
Figure 3B:
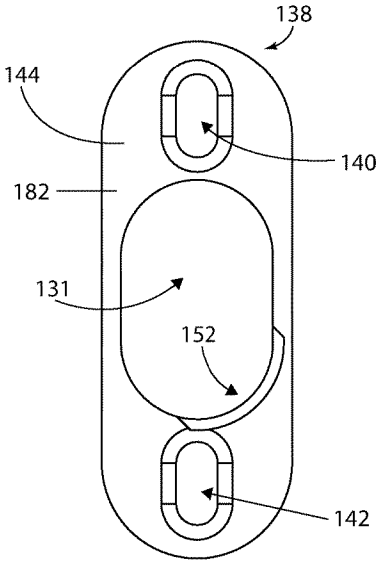
FIG. 3B is front view of the housing shown in FIG. 3A in accordance with an embodiment of the present disclosure.
Figure 5A:
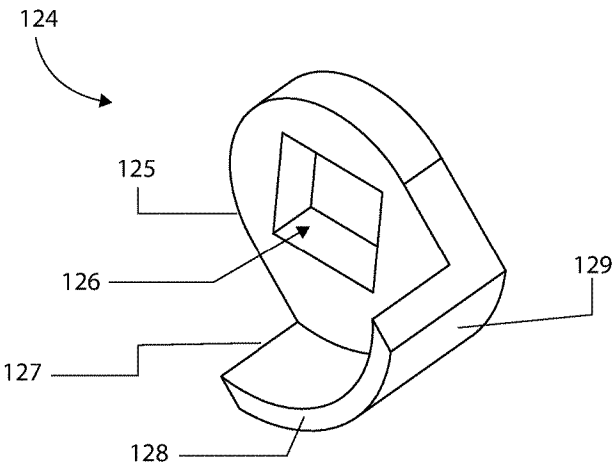
FIG. 5A is a perspective view of a retention piece of the locking device of FIG. 1A in accordance with an embodiment of the present disclosure.
Figure 5C:
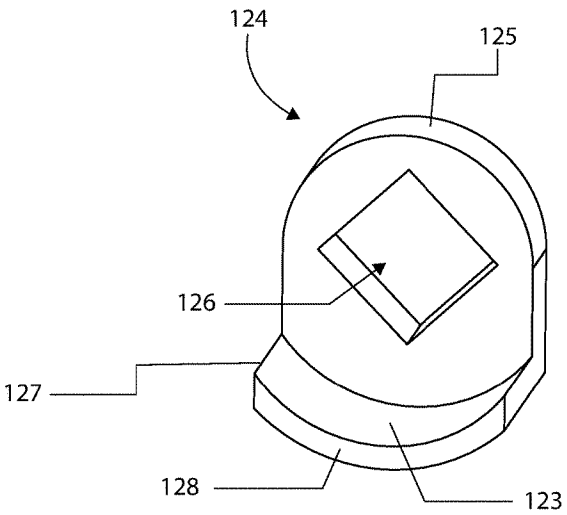
FIG. 5C is yet another perspective view of the retention piece shown in FIG. 5A in accordance with an embodiment of the present disclosure.
Figure 5B:
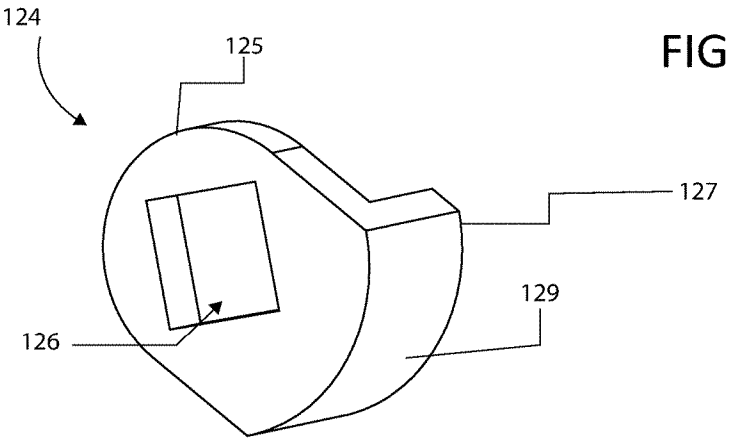
FIG. 5B is another perspective view of the retention piece shown in FIG. 5A in accordance with an embodiment of the present disclosure.

Referring to FIGS. 3A, B, and C, various views of housing 138 are shown in accordance with the present disclosure. As shown in FIGS. 3A-C, housing 138 includes a slot 152 disposed in an inner wall 183 of housing 138 and extending from end 182 of housing 138 toward interior 131 of housing 138. Slot 152 includes a surface 154 that is recessed within the inner wall 183 of housing 138 a ledge 156. In one embodiment, surface 154 is a concave surface. Slot 152 is configured to receive a portion of retention piece 124. For example, referring to FIGS. 5A, B, C, various views of retention piece 124 are shown in accordance with the present disclosure. Retention piece 124 includes a first portion 125, where first portion 125 includes square aperture 126, and a second portion 127, where second portion 127 is curved and extends out perpendicularly in relation to flat portion 125 as shown in FIGS. 5A-C. Second portion 127 of retention piece 124 includes curved surfaces 123 and 129 and edge 128, where curved surface 123 is concave and is opposite to curved surface 129 (which is convex). When barrel 118 is pulled away from housing 138, such that locking device 100 is in an unlocked position (shown in FIG. 1B), slot 152 is configured to receive second portion 127 of retention piece 124, such that, surface 129 of retention piece 124 meets surface 154 of slot 152 and edge 128 of retention piece 124 meets ledge 156 of slot 152.

Figure 4A:
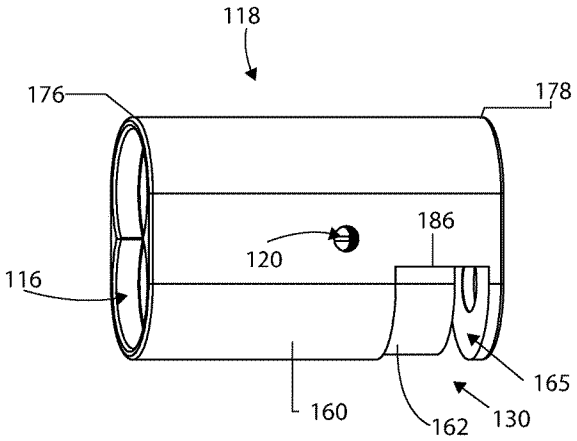
FIG. 4A is a perspective view of a barrel of the locking device of FIG. 1A in accordance with an embodiment of the present disclosure.

Referring to FIGS. 4A and B, barrel 118 is shown in greater detail in accordance with the present disclosure. As shown in FIGS. 4A and B, slot 130 of barrel 118 has a curved surface 162 and an aperture 165, where curved surface 162 is a convex surface. Aperture 165 provides access to an aperture 164 disposed within the interior of barrel 118. It is to be appreciated that curved surface 162 is recessed from outer surface 160 of barrel 118 (i.e., disposed closer to interior 116 of barrel 118 than outer surface 160 of barrel 118). Furthermore, barrel 118 includes aperture 166, where apertures 164 and 166 are aligned.

Figure 6B:
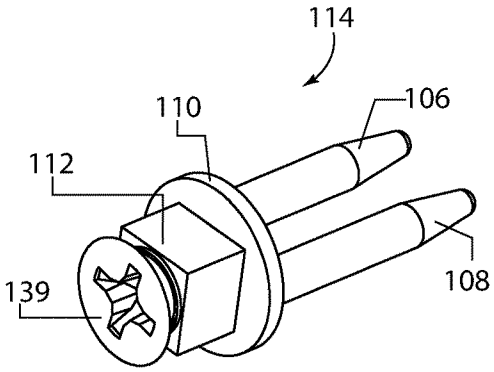
FIG. 6B is another perspective view of the prong driver shown in FIG. 6A in accordance with an embodiment of the present disclosure.
Figure 6A:
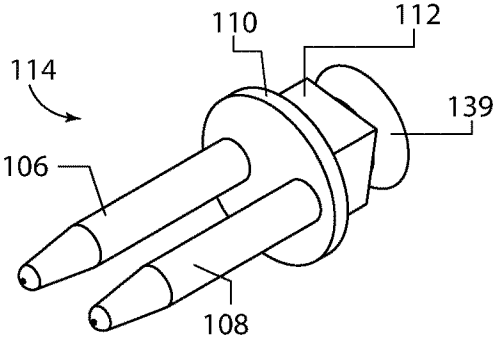
FIG. 6A is a perspective view of a prong driver of the locking device of FIG. 1A in accordance with an embodiment of the present disclosure.

Portion 125 of retaining piece 124 is disposed perpendicularly to longitudinal axis 150 through aperture 165 such that portion 125 of retaining piece 124 is disposed between apertures 164 and 166. In this way, square aperture 126 aligns with apertures 164 and 166 and surface 123 of retaining piece 124 is received by surface 162 of slot 130. When retaining piece 124 is disposed in slot 130, square peg 112 is disposed through apertures 164 and 126, and screw 139 is disposed through aperture 166 and an aperture on peg 112 (not shown) to secure driver 114 to barrel 118. It is to be appreciated that driver 114 is shown with screw 139 disposed in an aperture of peg 112 in FIGS. 6A and 6B.

Figure 4C:
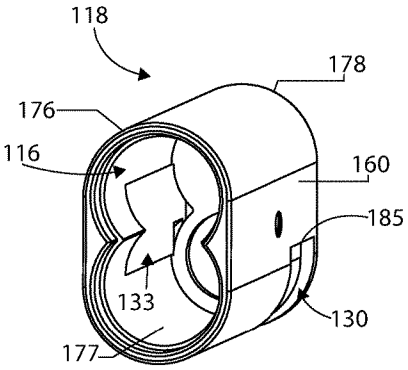
FIG. 4C is yet another perspective view of the barrel shown in FIG. 4A in accordance with an embodiment of the present disclosure.
Figure 4B:
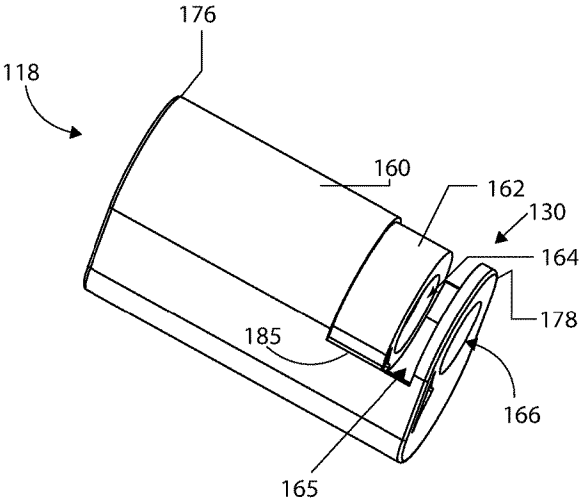
FIG. 4B is another perspective view of the barrel shown in FIG. 4A in accordance with an embodiment of the present disclosure.

Referring to FIG. 4C another perspective view of barrel 118 is shown in accordance with the present disclosure. As shown in FIG. 4C, barrel 118 includes slot 133 disposed in inner wall 177 of barrel 118. In one embodiment, when SFIC 104 is disposed in interior 116 of barrel 118, engaging element 190 is disposed in slot 133 to securely retain SFIC 104 in interior 115 of barrel 118. As stated above, when a master or control key is inserted into key hole 102 and turning (e.g., in a direction C, as indicated in FIG. 2B, SFIC 104 is configured such that engaging element 190 is drawn to the interior of SFIC 104 (e.g., in a direction D indicated in FIG. 2B) to release engaging element 190 from slot 133. When engaging element 190 is released from slot 133 of barrel 118, SFIC 104 may be removed from the interior of barrel 118. In this way, using the master key, SFIC 104 may be replaced with another SFIC 104, if desired, without removing or replacing the entirety of locking device 100.

Figure 7C:
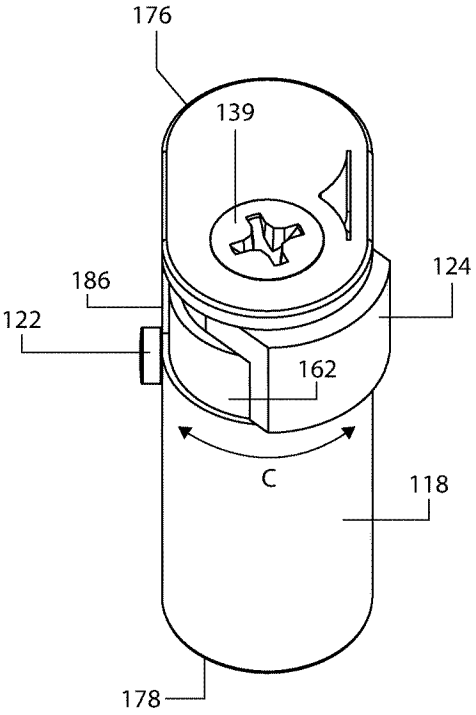
FIG. 7C is another perspective view of the locking device of FIG. 1A with the housing shown in FIG. 3A removed in accordance with an embodiment of the present disclosure.
Figure 7A:
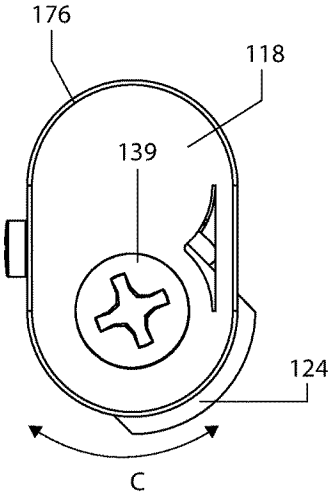
FIG. 7A is a front view of the locking device of FIG. 1A with the housing shown in FIG. 3A removed in accordance with an embodiment of the present disclosure.
Figure 7B:
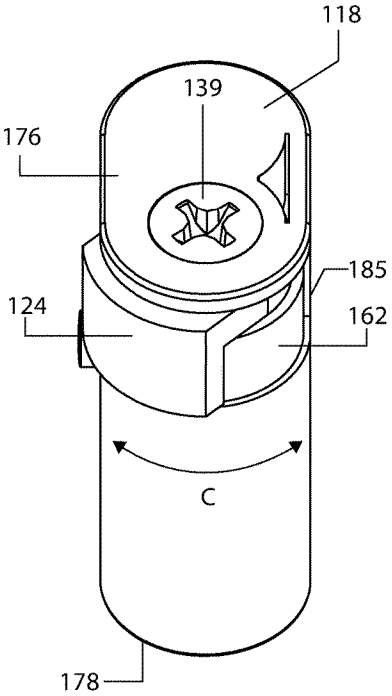
FIG. 7B is a perspective view of the locking device of FIG. 1A with the housing shown in FIG. 3A removed in accordance with an embodiment of the present disclosure.

Referring to FIGS. to 7A-C, locking device 100 is shown with housing 138 removed in accordance with the present disclosure. When a proper key is inserted into key hole 102 and rotated in a first direction (e.g., as indicated by C in FIGS. 1B and 2B), prongs 106 and 108 of driver 114 will also be rotated in the first direction, causing peg 112 to rotate in the first direction. Since peg 112 is disposed through aperture 126, the rotation of peg 112 in the first direction causes portion 127 of retaining piece 124 to rotate in a semi-circle in the first direction about the longitudinal axis 150 within slot 130 as indicated by arrow C in FIGS. 7A-C.

Referring to FIGS. 4A, 4B and 7B, 7C, it is to be appreciated that slot 130 includes a side 185 and an opposite side 186. Sides 185, 186 define the radius about longitudinal axis 150 that portion 127 of retaining piece 124 may be rotated. As portion 127 of retaining piece 124 is rotated about longitudinal axis 150 within slot 130 (as indicated by arrow C in FIGS. 7A-C), portion 127 may be rotated until portion 127 meets or touches side 185 of slot 130 or side 186 of slot 130.

Figure 8B:
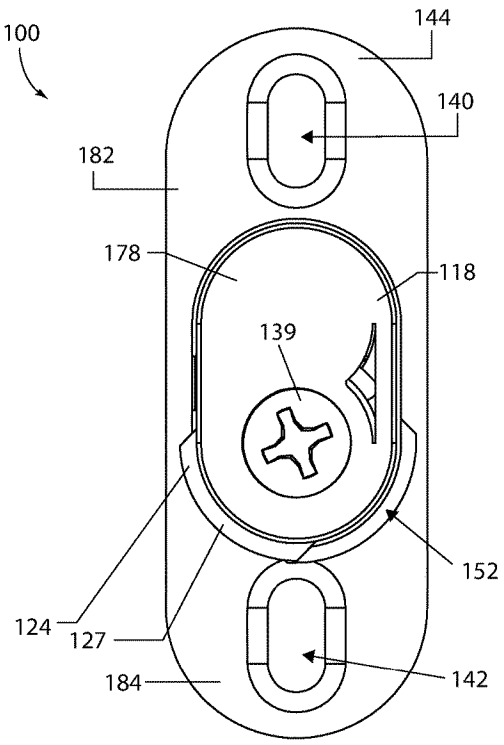
FIG. 8B is a rear view of the locking device of FIG. 1A in a locked position in accordance with an embodiment of the present disclosure.
Figure 8A:
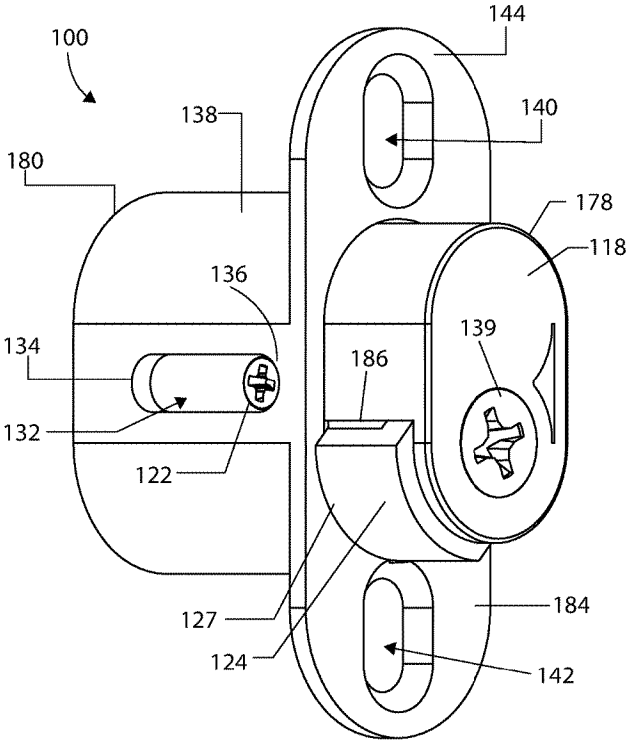
FIG. 8A is another perspective view of the locking device of FIG. 1A in a locked position in accordance with an embodiment of the present disclosure.

Referring to FIGS. 8A and 8B, locking device 100 is shown in a locked position in accordance with the present disclosure. As shown in FIG. 8B, when locking device 100 is in a locked position, portion 127 of retaining piece 124 is disposed at side 186 of slot 130 such that portion 127 of retaining piece 124 does not align with slot 152. Furthermore, in the locked position edge 128 of retaining piece 124 is disposed against an outer surface 184 of plate 144. In this way, barrel 118 cannot be slidably advanced along longitudinal axis 150 to an unlocked position (shown in FIG. 1B).

When a proper key is inserted into key hole 102 and rotated, portion 127 of retaining piece 124 is rotated to side 185 of slot 130 to align with slot 152. When portion 127 of retaining piece 124 is disposed toward side 185 of slot 130, barrel 118 may slidably advanced within interior 131 of housing 138 along longitudinal axis 150 (i.e., in a direction B shown in FIG. 1B) causing portion 127 of retaining piece 124 to be received by slot 152 and enabling locking device 100 to achieve an unlocked position.

Figure 9B:
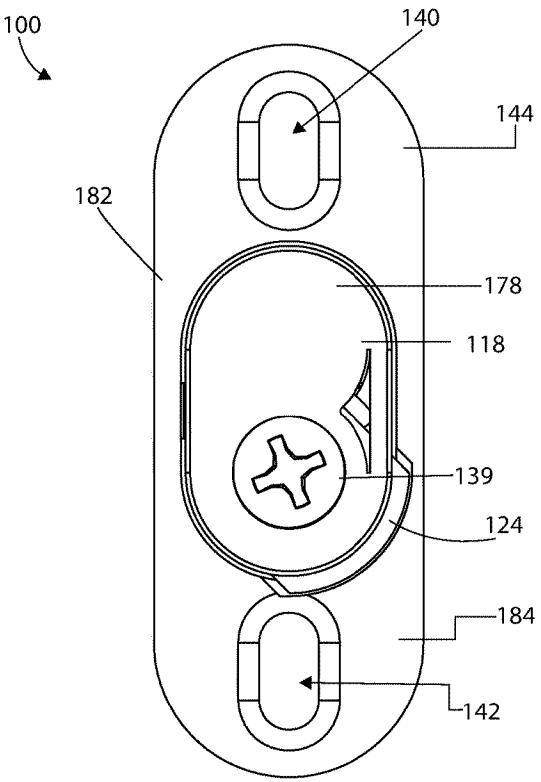
FIG. 9B is a rear view of the locking device of FIG. 1A in an open position in accordance with an embodiment of the present disclosure.
Figure 9A:
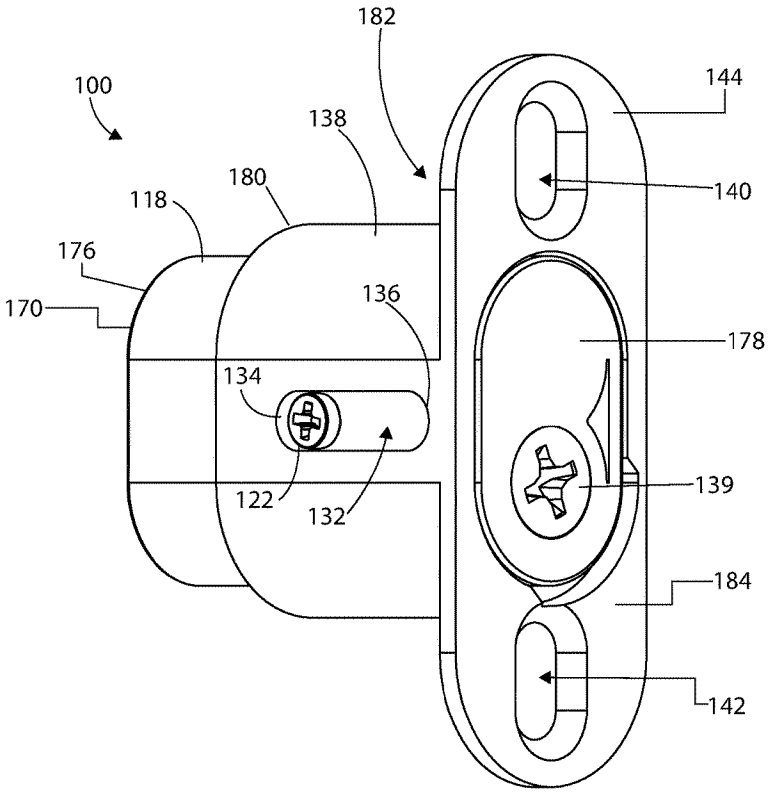
FIG. 9A is another perspective view of the locking device of FIG. 1A in an open position in accordance with an embodiment of the present disclosure.

Referring to FIGS. 9A and 9B, locking device 100 is shown in an unlocked position in accordance with the present disclosure. As shown in FIGS. 9A and 9B, in the unlocked position, portion 127 of retaining piece 124 is disposed in slot 152, such that, edge 128 of retaining piece 124 comes into contact with ledge 156 of slot 152. It is to be appreciated that because edge 128 of retaining piece 124 comes into contact with ledge 156 of slot 152 and travel stop 122 comes into contact with end 134 of slot 132, end 176 barrel 118 cannot be advanced along longitudinal axis 150 any further away (i.e., in a direction B shown in FIG. 1B) from housing 138.

Figure 10B:
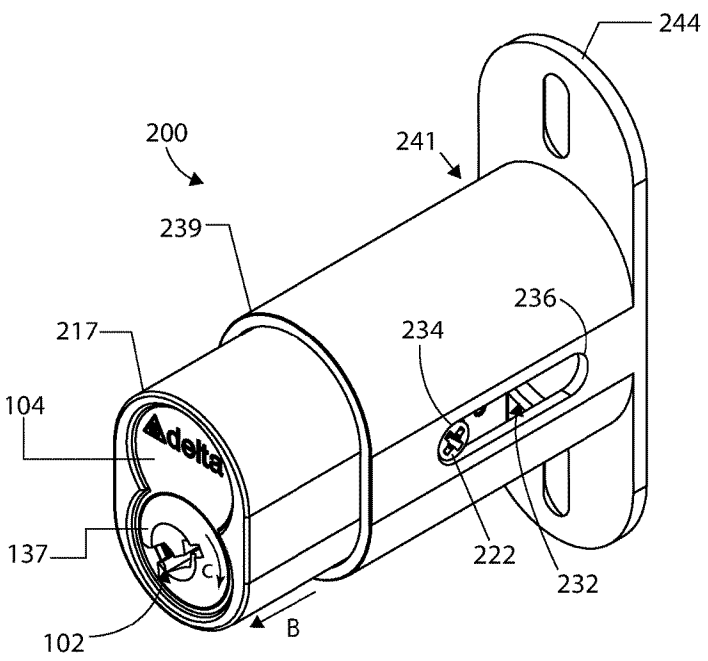
FIG. 10B is a perspective view of the locking device of FIG. 10A in an open position in accordance with an embodiment of the present disclosure.
Figure 10A:
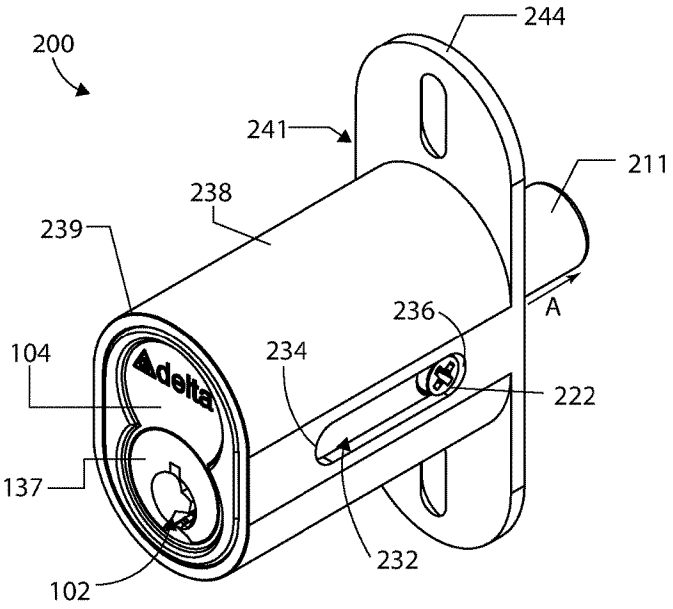
FIG. 10A is a perspective view of another locking device in a locked position in accordance with an embodiment of the present disclosure.

Referring to FIGS. 10A and 10B, a locking device 200 is shown in accordance with another embodiment of the present disclosure. FIG. 10A is a perspective view of locking device 200 in a locked position and FIG. 10B is a perspective view of locking device 200 in an unlocked position in accordance with the present disclosure.

Figure 11:
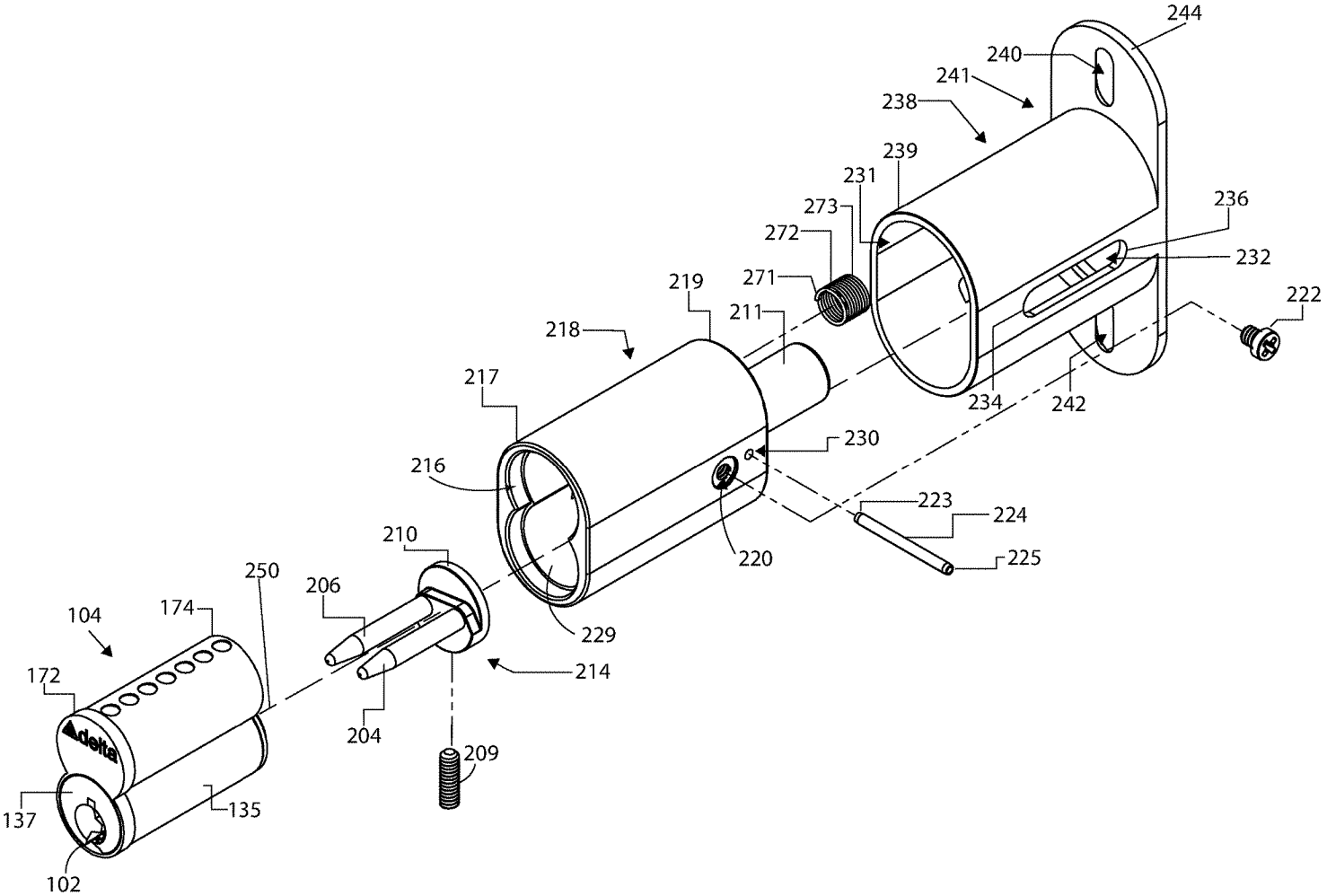
FIG. 11 is an exploded perspective view of the locking device of FIG. 10A in accordance with an embodiment of the present disclosure.
Figure 14C:
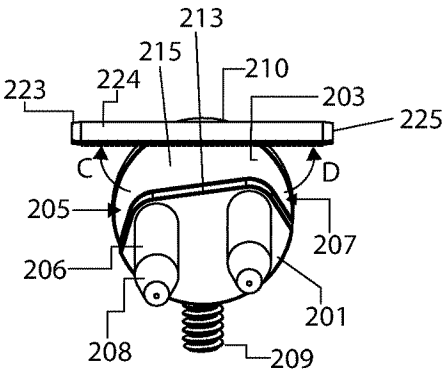
FIG. 14C is a perspective view of the prong driver shown in FIG. 14A and a pin of the locking device of FIG. 10A in accordance with an embodiment of the present disclosure.

Referring to FIG. 11, an exploded perspective view of locking device 200 is shown in accordance with the present disclosure. Locking device 200 includes SFIC 104. As described above, end 174 of SFIC 104 includes channels 191, 192, which are configured to receive prongs 206 and 208, respectively, of a driver 214. When a proper key is inserted into key hole 102 and rotated in a first direction (e.g., rotationally about longitudinal axis 250), cylinder 137 of SFIC 104 is also rotated in the first direction, thereby causing driver 214 to be rotated in the first direction. Prongs 206 and 208 are coupled to a plate 210 of driver 214, where prongs 206 and 208 extend perpendicularly from a surface 201 (shown in FIGS. 14A and 14C) of plate 210 along longitudinal axis 250. It is to be appreciated that driver 214 will be described in greater detail below. End 174 of SFIC 104 is disposed in the hollow interior 216 of barrel 218, where SFIC 104 and barrel 218 are each aligned along longitudinal axis 250.

Figure 13B:
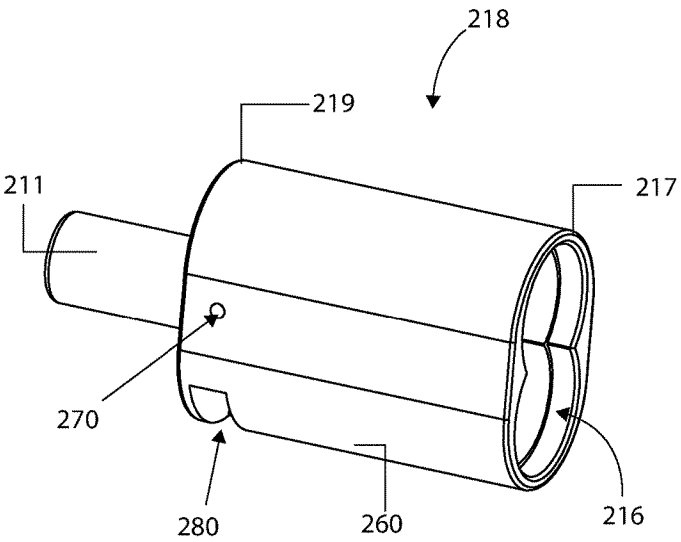
FIG. 13B is another perspective view of the barrel shown in FIG. 13A in accordance with an embodiment of the present disclosure.

Barrel 218 includes ends 217 and 219, where end 227 of SFIC 104 is disposed through end 217 into interior 216 of barrel 218. Barrel 218 also includes apertures 220 and 230 disposed through an outer wall 260 of barrel 218. Aperture 220 is configured to receive travel stop 222. Aperture 230 is configured to receive end 223 of a driver retention roll pin 224. Barrel 218 also includes aperture 270, where aperture 270 is shown in FIGS. 13B and 13D. Aperture 270 is configured to receive end 225 of pin 224. In this way, pin 224 is disposed in, and secured to, the interior of barrel 218 perpendicularly to longitudinal axis 250. Barrel 218 also includes a projection 211 extending from end 219 of barrel 218 along longitudinal axis 250, as will be described in greater detail below.

Barrel 218 is slidably disposed through end 239 into the hollow interior 231 of housing 238, where barrel 218 and housing 238 are each aligned along longitudinal axis 250. Barrel 218 is biased away from housing 238 by a coil spring 272 in a direction B (along longitudinal axis 250) as indicated in FIG. 10B. Housing 238 includes end 239 and 241. A plate 244 is disposed on end 241 of housing 238, where plate 244 includes aperture 240 and aperture 242 for coupling locking device 200 to a surface, such as the surface of a door. Housing 238 also includes a slot 232 having an end 234 and an opposite end 236. When barrel 218 is disposed in housing 238, a portion of travel stop 222 is disposed in slot 232. It is to be appreciated that when a proper or operating key (i.e., a key other than the master key used to actuate engaging element 190 of SFIC 104) is inserted into key hole 102 and rotated, barrel 218 is slidable along longitudinal axis 250 within housing 238 to lock and unlock device 200, as will be described in greater detail below. Slot 232 controls and limits the longitudinal front and back motion of barrel 218 relative to housing 238.

When the locking device 200 is locked (as shown in FIG. 10A), travel stop 222 will be at end 236 of slot 232 and projection 211 will extend passed end 241 (i.e., passed plate 244) of housing 238 in a direction A (as shown in FIG. 10A) along longitudinal axis 250. It is to be appreciated that in the locked position, projection 211 is configured to interact with a receptacle, such as a door jam, to secure an object, such as a door, in a locked or closed position. When locking device 100 is unlocked (as shown in FIG. 10B), spring 272 is configured to bias barrel 218 in a direction B along longitudinal axis 250 away from housing 238 and travel stop 222 will be at end 234 of slot 232 and barrel 218 will extend passed side 239 of housing 218 (as shown in FIG. 10A).

Figure 12A:
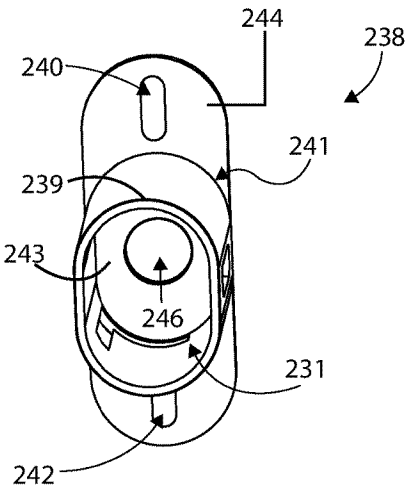
FIG. 12A is a perspective view of a housing of the locking device of FIG. 10A in accordance with an embodiment of the present disclosure.
Figure 12C:
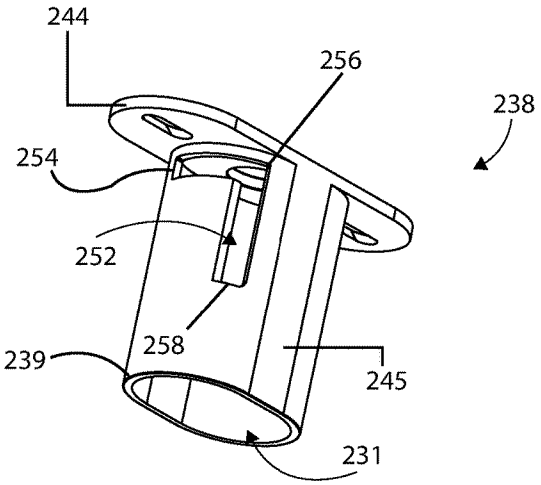
FIG. 12C is another perspective view of the housing shown in FIG. 12A in accordance with an embodiment of the present disclosure.
Figure 12B:
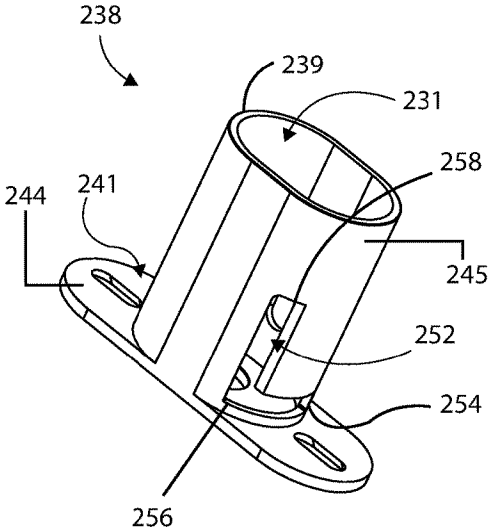
FIG. 12B is another perspective view of the housing shown in FIG. 12A in accordance with an embodiment of the present disclosure.

Referring to FIGS. 12A, B, and C, various views of housing 238 are shown in accordance with the present disclosure. As shown in FIG. 12A, end 241 of interior 231 includes a surface or wall 243. Surface 243 includes aperture 246, where aperture 246 is configured to receive at least a portion of projection 211 when barrel 218 is slidably advanced along longitudinal axis 250 toward plate 244, such that, locking device 200 achieves a locked position. Exterior wall 245 of housing 238 includes a slot 252, where, in one embodiment, slot 252 is configured in an L-shape. Slot 252 includes ends 254 and 258 and a middle or pivot point 258.

Figure 13A:
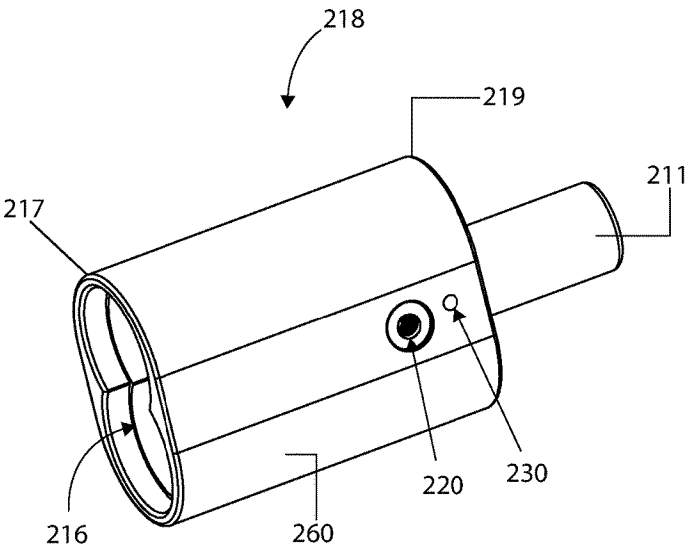
FIG. 13A is a perspective view of a barrel of the locking device of FIG. 1A in accordance with an embodiment of the present disclosure.
Figure 13D:
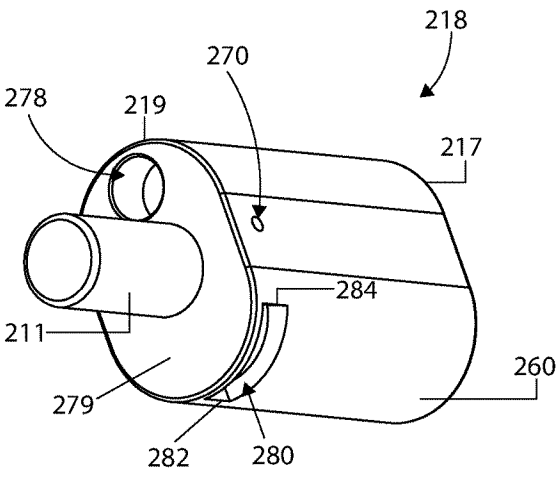
FIG. 13D is another perspective view of the barrel shown in FIG. 13A in accordance with an embodiment of the present disclosure.

Referring to FIGS. 13A, B, C, and D, various views of barrel 218 are shown in accordance with the present disclosure. As shown in FIGS. 13B and D, barrel 218 includes slot 280 disposed through exterior surface or wall 260 of barrel 218. Slot 280 includes ends 282 and 284. Barrel 218 also includes slot 278 of exterior surface 279. It is to be appreciated that slot 278 is configured to receive spring 272, as will be described in greater detail below.

Referring to FIG. 13E, a cross-sectional view of barrel 218 is shown in accordance with the present disclosure. As shown in FIG. 13E, barrel 218 includes an inner wall 229, where inner wall 229 includes a slot 233. In one embodiment, slot 233 is configured to receive engaging element 190 of SFIC 104 to retain SFIC 104 in interior 216 of barrel 218. As described above, a master key may be inserted into key hole 102 to draw engaging element 190 toward the interior of SFIC 104. When engaging element 190 is drawing toward the interior of SFIC 104, engaging element 190 is released from slot 233 of barrel 218 and SFIC 104 may be removed as desired.

Also, as shown in FIG. 13E, slot 278 includes an inner wall 299. End 271 of coil 272 is configured to be received by slot 278 such that end 271 of coil 272 is disposed on wall 299. It is to be appreciated that the distance from end 219 of barrel 218 to the inner wall 299 of slot 280 is such that, when coil 272 is compressed, the entirety of coil 272 (i.e., from end 271 to end 273) fits within slot 280.

Figure 14A:
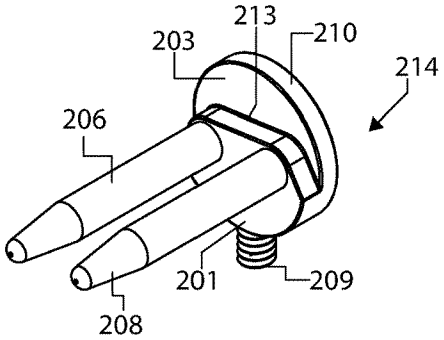
FIG. 14A is a perspective view of a prong driver of the locking device of FIG. 10A in accordance with an embodiment of the present disclosure.
Figure 14B:
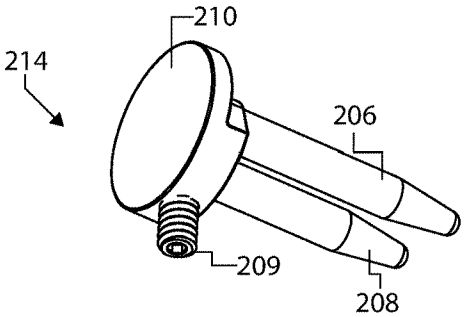
FIG. 14B is another perspective view of the prong driver shown in FIG. 14A in accordance with an embodiment of the present disclosure.

Referring to FIGS. 14A, B, and C, various views of driver 214 are shown in accordance with the present disclosure. As shown in FIGS. 14A and B, plate 210 is coupled to engaging element 209. Engaging element 209 extends out from plate 210 in a direction perpendicular to longitudinal axis 250. As will be described below, slots 280 and 252 are configured to receive engaging element 209. Also, plate 210 includes surfaces 203 and 201, where prongs 206 and 208 are coupled to, and extend from, surface 201 parallel to longitudinal axis 250. Surface 201 protrudes away from surface 203, such that, a ledge 213 is formed. Ledge 213 includes portions 205, 207, and 215, where portions 205 and 207 are each adjacent to portion 215 of ledge 213 (i.e., portion 215 is disposed between portions 205 and 207). In one embodiment, each of portions 205 and 207 of ledge 213 form an acute angle relative to portion 215 of ledge 213.

When a proper key is inserted into key hole 102 and rotated, e.g., in a clockwise direction about axis 250, thereby rotating driver 214 (as indicated by arrow C in FIG. 14C), portion 205 of ledge 213 is configured to come into contact with pin 224, such that, driver 214 cannot be rotated in clockwise direction C any further. When a proper key is inserted into key hole 102 and rotated counterclockwise, thereby rotating driver 214 (as indicated by arrow D in FIG. 14D), portion 207 of ledge 213 is configured to come into contact with pin 224, such that, driver 214 cannot be rotated anymore in counterclockwise direction D. It is to be appreciated the when driver 214 is rotated either clockwise or counterclockwise, portion 215 of ledge 213 does not come into contact with pin 224. In this way, portions 205, 207 of driver 214 and pin 224 work together to limit the rotational range of driver 214 about longitudinal axis 250.

Figure 15B:
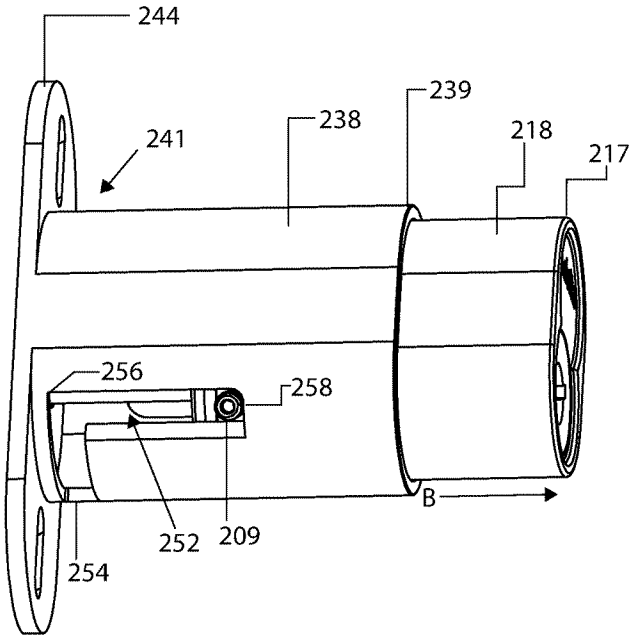
FIG. 15B is another perspective view of the locking device of FIG. 10A in an unlocked position in accordance with an embodiment of the present disclosure.
Figure 15A:
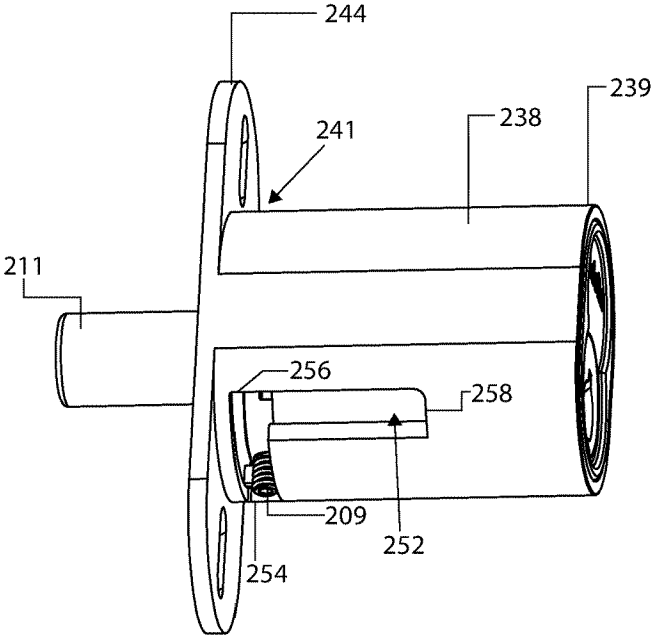
FIG. 15A is another perspective view of the locking device of FIG. 10A in a locked position in accordance with an embodiment of the present disclosure.
Figure 15D:
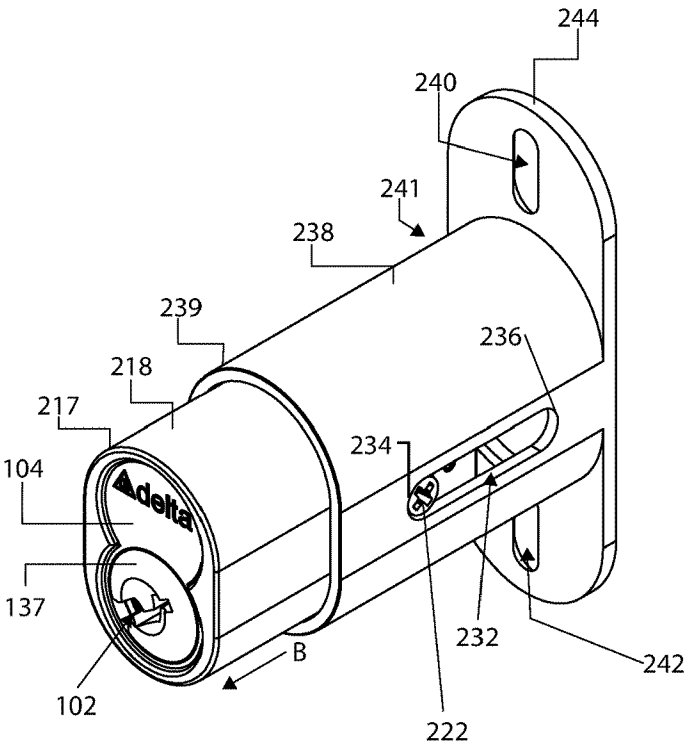
FIG. 15D is another perspective view of the locking device of FIG. 10A in an unlocked position in accordance with an embodiment of the present disclosure.

Referring to FIGS. 15A, B, C, and D, various views of locking device 200 are shown according with the present disclosure, where FIGS. 15A and C show locking device 200 in a locked position and FIGS. 15B and D show locking device 200 in an unlocked position. As shown in FIGS. 15A and 15B, engaging element 209 from plate 210 of driver 214 through each of slots 252 and 280. The combination of engaging element 209 and slots 252 and 280 define the locking and unlocking motion of locking device 200.

Figure 15C:
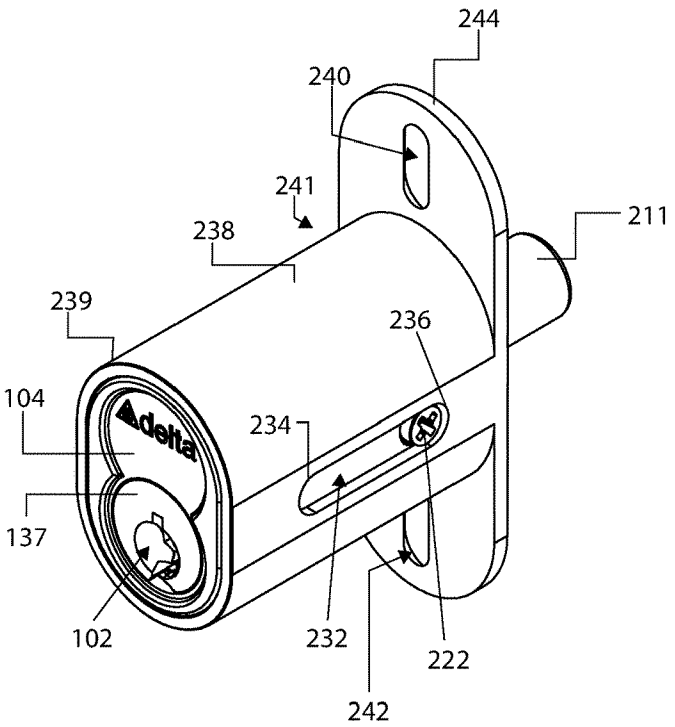
FIG. 15C is another perspective view of the locking device of FIG. 10A in a locked position in accordance with an embodiment of the present disclosure.

As shown in FIG. 15A, when locking device 200 is in a locked position, engaging element 209 is disposed in end 254 of slot 252. Furthermore, engaging element 209 is disposed in end 282 of slot 280 (shown in FIG. 16A). It is to be appreciated that the portion of slot 252 between side 254 and middle point 256 is aligned perpendicularly to (i.e., crossing) longitudinal axis 250. In this way, when engaging element is disposed in end 254 of slot 252, barrel 218 is retained in the interior 231 of housing 238 and prevented from slidably advancing along the longitudinal axis 250. As shown in FIGS. 15A and 15C, while locking device 200 is in the locked position, projection 211 is disposed through aperture 246 and extended passed end 241 of housing 238. As stated above, when projection 211 is extended passed end 241 of housing 238 along longitudinal axis 250, projection 211 may interact with a receptacle of a door (or any other object) to secure the door in a locked position.

Figure 16B:
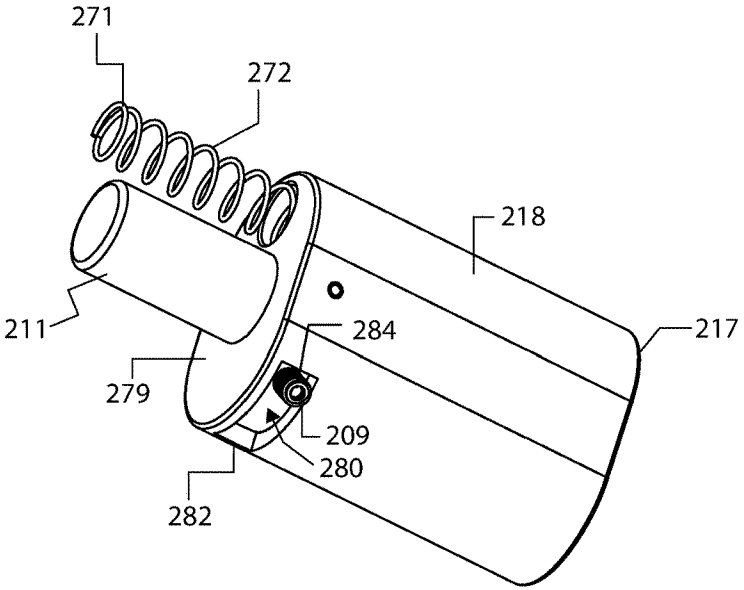
FIG. 16B is a perspective view of the locking device of FIG. 10A in an unlocked position with the housing shown in FIG. 12A removed in accordance with an embodiment of the present disclosure.
Figure 16A:
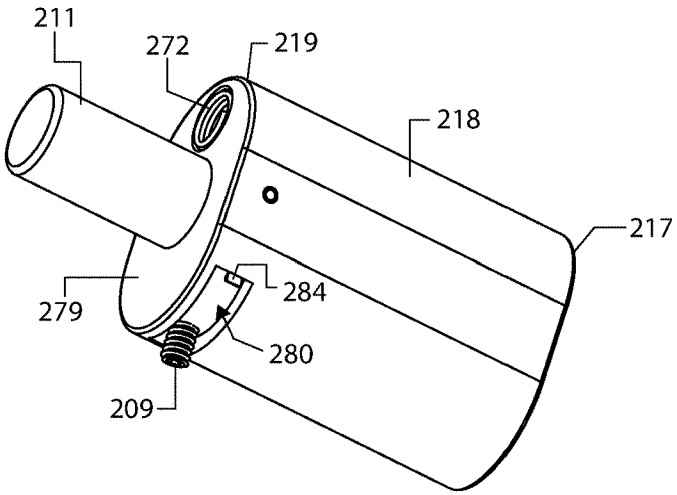
FIG. 16A is a perspective view of the locking device of FIG. 10A in a locked position with the housing shown in FIG. 12A removed in accordance with an embodiment of the present disclosure.

In the locked position, slots 280 and 252 are aligned, such that, end 254 of slot 252 is aligned with end 282 of slot 280 and middle point 256 of slot 252 is aligned with end 284 of slot 280 such that the portion of slot 252 between side 252 and middle point 256 and slot 280 are aligned. In this way, to unlock locking device 200, a proper key is inserted into key hole 102 and rotated in a first direction about longitudinal axis 250 (e.g., in a direction C as indicated in FIG. 10B) such that driver 214 will be rotated in the first direction, causing engaging element 209 to travel perpendicularly to longitudinal axis 250 from end 254 of slot 252 to middle or pivot point 256 of slot 252 and from end 282 to end 284 of slot 280 (where slot 280 and engaging element 209 are shown in FIGS. 16A and 16B). It is to be appreciated that the portion of slot 252 between end 258 and middle point 256 is aligned along longitudinal axis 250. At middle point 256 of slot 252, spring 272 will bias barrel 218 in a direction B (indicated in FIG. 15B) along longitudinal axis 250 away from housing 238 and engaging element 209 will now be free to travel from middle point 256 of slot 252 to end 258 of slot 252, such that locking device 200 achieves an unlocked position. It is to be appreciated that while engaging element 209 travels from middle point 256 to end 258 of slot 252, engaging element 209 remains in end 284 of slot 280.

Figure 13C:
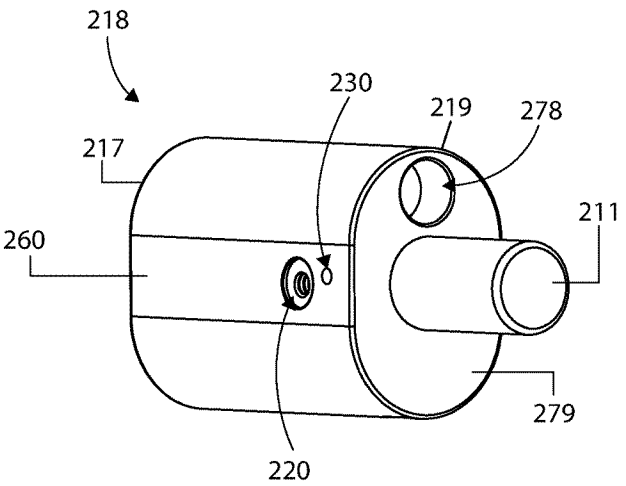
FIG. 13C is another perspective view of the barrel shown in FIG. 13A in accordance with an embodiment of the present disclosure.
Figure 17B:
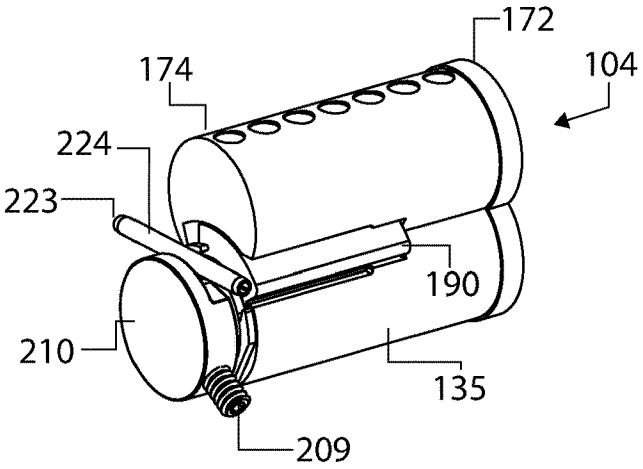
FIG. 17B is a perspective view of the locking device of FIG. 10A in an unlocked position with the housing shown in FIG. 12A and the barrel shown in FIG. 13A removed in accordance with an embodiment of the present disclosure.
Figure 17A:
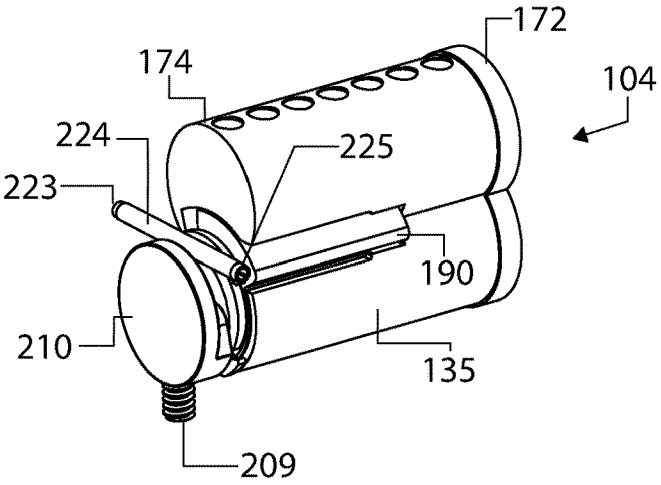
FIG. 17A is a perspective view of the locking device of FIG. 10A in a locked position with the housing shown in FIG. 12A and the barrel shown in FIG. 13A removed in accordance with an embodiment of the present disclosure.

Referring to FIGS. 16A and 16B locking device 200 is shown with housing 238 removed in accordance with the present disclosure. In FIG. 16A, locking device 200 is shown in a locked position, where engaging element 209 is disposed in slot 280 at end 282. In FIG. 16B, locking device 200 is shown in an unlocked position, where engaging element 209 is disposed in slot 280 at end 284. Furthermore, referring to FIGS. 17A and B, locking device 200 is shown with housing 238 and barrel 218 removed in accordance with the present disclosure. In FIG. 17A, locking device 200 is shown in a locked position, and, in FIG. 17B, locking device 200 is shown in an unlocked position. As shown in FIG. 16A, when locking device 200 is in a locked position, spring 272 is compressed within slot 278. It is to be appreciated that end 271 of spring 272 is disposed in slot 278 (shown in FIG. 13C) against wall 299 and end 273 of spring 272 is disposed on surface 243 of housing 238 (where surface 243 is shown in FIG. 12A). The force exerted by spring 272 against wall 299 of barrel 218 and surface or wall 242 of housing 238 biases barrel 218 away from housing 238 in a direction along longitudinal axis 250.

The distance from end 219 of barrel 218 to wall 299 of slot 299 is configured such that, when spring 272 is fully compressed by surface 243 and wall 299 as barrel 218 is slidably advanced toward the interior 231 of housing 238 to bring locking device 200 to a locked position, the entirety of spring 272 fits within slot 278. This feature allows surface 243 of housing 238 to sit flushly against surface 279 of barrel 218 when locking device 200 is in a locked position, thereby decreasing the overall length of housing 238 from end 239 to end 241 that is needed to fit barrel 218 and SFIC 104 within the interior 231 of housing 238 when locking device 200 is in the locked position.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking device, comprising:

a housing including a first end and a second end, the housing extending along a longitudinal axis, the housing further including a first slot and an outer wall defining a hollow interior, the first slot disposed through the outer wall of the housing and including a first end, a second end, and a middle point, wherein a first portion of the first slot extends along the longitudinal axis from the first end to the middle point and a second portion of the slot extends perpendicularly to the longitudinal axis from the middle point to the second end;

a barrel including a first end and a second end, the second end of the barrel disposed through the first end of the housing into the hollow interior of the housing such that the barrel is slidable along the longitudinal axis, the barrel further including an outer wall defining a hollow interior and a second slot disposed through the outer wall of the barrel, the second slot including a first end and a second end and extending perpendicularly to the longitudinal axis;

an interchangeable core retained in the hollow interior of the barrel including a first end and a second end, the first end including a key hole; and a prong driver coupled to the second end of the interchangeable core, the prong driver including an engaging element, the engaging element extending from the prong driver into the first slot and the second slot in a direction perpendicular to the longitudinal axis, wherein when a proper key is inserted into the key hole of the interchangeable core and rotated in a first direction or a second direction opposite the first direction, the engaging element of the prong driver is rotated in the first direction or the second direction perpendicular to the longitudinal axis, wherein when the locking device is in a locked position, the engaging element is disposed through the second end of the first slot and the second end of the second slot such that the alignment of the second portion of the first slot perpendicular to the longitudinal axis prevents the barrel from sliding along the longitudinal axis, and wherein to unlock the locking device, the proper key is inserted into the key hole to rotate the engaging element such that the engaging element advances from the second end of the first slot to the middle point of the first slot and from the second end of the second slot to the first end of the second slot, thereby allowing the barrel to be advanced along the longitudinal axis in a direction away from the housing as the engaging element slides from the middle point of the first slot to the second end of the second slot along the longitudinal axis.

2. The locking device of claim 1, wherein when the locking device is unlocked, the first end of the barrel is advanced passed the first end of the housing.

3. The locking device of claim 1, wherein the barrel includes a projection extending from the second end of the barrel along the longitudinal axis such that when the barrel is slidably advanced along the longitudinal axis toward second end of the housing, the projection extends passed second end of the housing.

4. The locking device of claim 1, wherein the second end of the housing includes at least one mounting member configured to mount the locking device to a surface.

5. The locking device of claim 1, wherein the interchangeable core includes a second engaging element and the hollow interior of the barrel includes a third slot configured to receive the second engaging element, wherein when the second engaging element is disposed in the third slot, the interchangeable core is securely retained in the hollow interior of the barrel.

6. The locking device of claim 5, wherein when a master key is inserted into the key hole of the interchangeable core and rotated in the first direction, the second engaging element is released from the third slot to allow the interchangeable core to be removed from the hollow interior of the barrel.

7. The locking device of claim 1, further comprising a coil having a first end and a second end and wherein the hollow interior of the housing includes an inner surface disposed toward the second end of the housing, the coil is disposed in the hollow interior of the housing between the second end of the barrel and inner surface of the housing such that the first end of the coil is disposed adjacent to the second end of the barrel and the second end of the coil is disposed adjacent to the inner surface of the housing, the coil configured to bias the barrel in a direction along the longitudinal axis away from the second end of housing.

8. The locking device of claim 7, wherein the second end of the barrel includes an outer surface, the outer surface including a third slot, the third slot including an inner wall, wherein the first end of the coil is disposed through the third slot against the inner wall of the third slot.

9. The locking device of claim 8, wherein when the barrel is advanced toward the second end of the housing along the longitudinal axis to a locked position, the coil is compressed between the inner wall of the third slot and the inner surface of the housing such that the coil is completely disposed within the third slot and the outer surface of the second end of the barrel and the inner surface of the housing allowing the outer surface of the second end of the barrel to come into contact with the inner surface of the housing.

10. The locking device of claim 1, wherein the barrel further includes a second engaging element extending from the outer wall of the barrel in a direction perpendicular to the longitudinal axis and the housing includes a third slot disposed through the outer wall of the housing, the third slot aligned along the longitudinal axis, the second engaging element extending into the third slot, wherein the third slot is configured to slidably retain the second engaging element to limit the range of movement of the barrel along the longitudinal axis.

11. The locking device of claim 1, further comprising a pin coupled to the hollow interior of the barrel such that the pin is aligned perpendicularly to the longitudinal axis, wherein the prong driver includes a ledge configured to come into contact with the pin when the proper key is inserted into the key hole and rotated to limit the rotational motion of the prong driver.

12. The locking device of claim 11, wherein the ledge of the prong driver includes a first portion, a second portion, and a third portion, the second portion disposed between the first portion and the third portion and the first portion and third portion each forming an acute angle relative the second portion, and wherein when the proper key is inserted into the key hole and rotated in the first direction, the first portion of the ledge comes into contact with the pin to limit the rotational motion of the prong driver in the first direction and when the proper key is inserted into the key hole and rotate in the second direction, the third portion of the ledge comes into contact with the pin to limit the rotational motion of the prong driver in the second direction.

13. The locking device of claim 1, wherein the interchangeable core is a small format interchangeable core.

14. A locking device, comprising:

a housing including a first end and a second end, the housing extending from the first end to the second end along a longitudinal axis, the housing further including an outer wall defining a hollow interior of the housing and a first surface on the second end of the housing, the hollow interior including an inner wall, the inner wall including a first slot extending from the first surface toward the first end of the housing;

a barrel including a first end and a second end, the second end of the barrel disposed through the first end of the housing into the hollow interior of the housing such that the barrel is slidable along the longitudinal axis, the barrel further including an outer wall defining a hollow interior and a second slot disposed in the outer wall of the barrel, the second slot including a first side and a second side, the second slot further including a second surface that is recessed from the outer wall of the barrel and a first aperture configured to provide access to the hollow interior of the barrel;

an interchangeable core retained in the hollow interior of the barrel, the interchangeable core including a first end and a second end, the first end including a key hole;

a retaining piece disposed in the second slot, the retaining piece including a first portion and a second portion, the first portion extending perpendicularly to the longitudinal axis through the aperture of the second slot and into the hollow interior of the housing, the second portion extending from the first portion along the longitudinal axis and disposed adjacent to the second surface of the first slot such that at least part of the second portion of the retaining piece protrudes passed the outer wall of the barrel toward the exterior of the outer barrel; and a prong driver coupled to the second end of the interchangeable core and to the first portion of the retaining piece, wherein when a proper key is inserted into the key hole of the interchangeable core and rotated, the prong driver is rotated, thereby rotating the second portion of the retaining piece about the longitudinal axis such that the second portion of the retaining piece is advanced toward the first side or second side of the first slot, wherein when the locking device is in a locked position, the retaining piece and the second end of the barrel are disposed passed the second end of the housing and the second portion of the retaining piece is disposed toward the first side of the second slot such that the second portion of the retaining piece is adjacent to the first surface of the housing, thereby preventing the barrel from being slidably advanced toward the first end of the barrel along the longitudinal axis to an unlocked position, and wherein to unlock the locking device, the proper key is inserted into the key hole and rotated to rotate the second portion of the retaining piece from the first end of the second slot toward the second end of the second slot such that the second portion of the retaining piece is aligned with the first slot, thereby allowing the barrel to be advanced along the longitudinal axis in a direction toward the first end of the housing as the retaining piece slides along the longitudinal axis into the first slot.

15. The locking device of claim 14, wherein the barrel further includes an engaging element extending from the outer wall of the barrel in a direction perpendicular to the longitudinal axis and the housing includes a third slot disposed through the outer wall of the housing, the third slot aligned along the longitudinal axis, the engaging element extending into the third slot, wherein the third slot is configured to slidably retain the engaging to limit the range of movement of the barrel along the longitudinal axis.

16. The locking device of claim 14, wherein the interchangeable core includes an engaging element and the hollow interior of the barrel includes a third slot configured to receive the engaging element, wherein when the engaging element is disposed in the third slot, the interchangeable core is securely retained in the hollow interior of the barrel.

17. The locking device of claim 16, wherein when a master key is inserted into the key hole of the interchangeable core and rotated in the first direction, the engaging element is released from the third slot to allow the interchangeable core to be removed from the hollow interior of the barrel.

18. The locking device of claim 14, wherein the second end of the housing includes at least one mounting member configured to mount the locking device to a surface.

19. The locking device of claim 14, wherein the interchangeable core is a small format interchangeable core.

20. The locking device of claim 14, wherein the first portion of the retaining piece includes a non-circular aperture and the prong driver includes a non-circular peg, wherein the non-circular peg extends into the non-circular aperture of the retaining piece.

* * * * *